United States Patent [19]

Scholefield

[11] 4,087,897

[45] May 9, 1978

[54] METHOD OF MAKING AN END CONNECTION TO A FLUID POWER CYLINDER AND PRODUCT

[75] Inventor: Edward Harold Scholefield, Wilmington, Ohio

[73] Assignee: Airmatic/Beckett-Harcum, Inc., Wilmington, Ohio

[21] Appl. No.: 669,280

[22] Filed: Mar. 22, 1976

[51] Int. Cl.[2] ..... B21D 39/00; B23P 11/00

[52] U.S. Cl. ..... 29/509; 29/517; 92/165 R; 403/285

[58] Field of Search ..... 29/516, 517, 509, 511; 285/382; 92/165; 403/285

[56] References Cited

U.S. PATENT DOCUMENTS

| | | | |
|---|---|---|---|
| 1,092,464 | 4/1914 | Watson et al. | 285/382 X |
| 1,322,250 | 11/1919 | Lewis | 285/382 X |
| 3,326,006 | 6/1967 | Mount | 285/382 X |
| 3,417,456 | 12/1968 | Carlson | 285/382 X |
| 3,811,367 | 5/1974 | Bimba | 29/516 X |

*Primary Examiner*—Charlie T. Moon

*Attorney, Agent, or Firm*—Tilton, Fallon, Lungmus & Chestnut

[57] ABSTRACT

A method of making an end connection to a fluid power cylinder and product wherein a hollow metallic cylindrical tubing is deformed into a step shape to conform to a channel shaped recess provided in the shank of the end cap.

4 Claims, 4 Drawing Figures

METHOD OF MAKING AN END CONNECTION TO A FLUID POWER CYLINDER AND PRODUCT

BACKGROUND AND SUMMARY OF INVENTION

This invention relates to a method of making an end connection to a fluid power cylinder and the product resulting therefrom and, more particularly, to a permanent connection wherein the component parts are integrated in such a fashion as to resist substantial shock forces tending to destroy the connection.

This invention relates to that type of fluid power cylinder which has come to be designated "non-repairable". As such, the various components of the cylinder are permanently ingtegrated at the time of manufacture so that the resulting cylinders are relatively inexpensive and can be readily replaced — as contrasted to being repaired. Although the cost of repair labor is high, it is still necessary to provide a relatively inexpensive cylinder unit which can be discarded after it has worn out, or otherwise failed. Since these cylinders often are in installations where they encounter impact loads at very high rates of cycling, it is of real importance to have the parts well integrated, particularly the end caps and the cylinder casing. Failure of this joint or connection could release the piston rod, for example, like a projectile with the capability of significant damage and possible injury to the persons in the vicinity. Thus, those in this art faced a dilemma; the parts had to be inexpensive and readily integrated on the one hand yet, on the other hand, the connection had to be rugged and strong enough to withstand the impact load.

For many years the art has employed a simple technique of deforming (as by rolling) the end portion of the casing into a sloping-sided trough provided in the end cap, and thereafter peening (again as by rolling) a portion of the end cap over the rolled portion of the casing. This has been deemed inadequate by the workers in this art to withstand the severe and repetitive shock loads. For example, the well known construction referred to above was augmented by a clamping ring in U. S. Pat. No. 3,811,367. Even this construction was deemed less than satisfactory because in a subsequent patent (U. S. Pat. No. 3,848,325) the encircling band was further rigidified through the use of annular ribs.

I have discovered that the problem of satisfactory connection between the tubing and end cap can be advantageously solved through the use of a differently contoured trough — more particularly an annular recess provided in the shank which has a channel shape so as to develop a pronounced right angled step in the casing end portion so as to provide the desired locking securement. According to the method of the invention, the aforementioned right angled step is developed through metal deformation (again as by rolling) but with the imposition of axial force on the tubing which results in the advantageous cold working and flow of metal from the casing into the area of the desired joint.

Other advantages and objects of the invention may be seen in the details set down in the ensuing specification.

DETAILED DESCRIPTION

The invention is described in conjunction with an illustrative embodiment in the accompanying drawing, in which.

Figure 1:
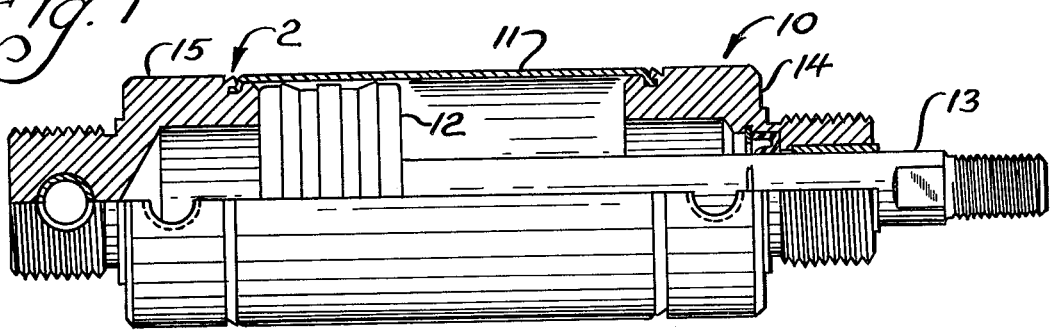
FIG. 1 is an elevational view, partially in section, of a fluid power cylinder constructed according to the teachings of this invention.

In the illustration given and with reference first to FIG. 1, the numeral 10 designates generally a fluid power cylinder. The cylinder 10 includes a hollow metallic cylindrical tubing 11 which is open at the ends thereof. Slidably mounted within the tubing 11 is a piston 12 and extending to the right therefrom (in the illustration given) is a piston rod 13.

The work end of the cylinder 10 is closed by an end cap 14 and the power end of the cylinder is closed by an end cap 15. Inasmuch as the connections between the end caps 14 and 15 in the tubing 11 are the same, only the connection between the end cap 15 and the tubing 11 will be described. However, it will be appreciated that for a cylinder to suitably withstand the severe cyclic shock loads, both ends must be equipped with connections of equal strength.

Figure 2:
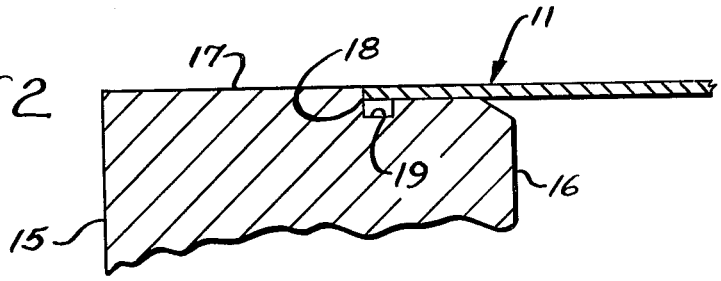
FIG. 2 is an enlarged fragmentary sectional view of the portion of FIG. 1 encircled in the upper left hand portion and designated by the numeral 2 -- and differing therefrom in having the parts disposed for the initial step of joint fabrication.

Reference is now made to FIG. 2. There the end cap 15 is depicted only in fragmentary form — as would be seen in a radial section through the axis common to the end cap 15 and the tubing 11. The end cap 15 is seen to be partially inserted into or received by the tubing 11 and the portion received or shank is designated by the numeral 16. The remainder of the cap (to the left in FIG. 2) is designated by the numeral 17. The shank 16 has a diameter reduced relative to the portion 17 and therefore defines therewith a shoulder 18. The shank 16, immediately adjacent the shoulder 18, is equipped with a channel-shaped, annular, inwardly-extending recess 19. From a consideration of FIG. 2, it will be seen that the shank 16 has been positioned within the tubing 11 so that the end portion of the tubing 11 overlies the recess 19 and abuts the shoulder 18.

Figure 3:
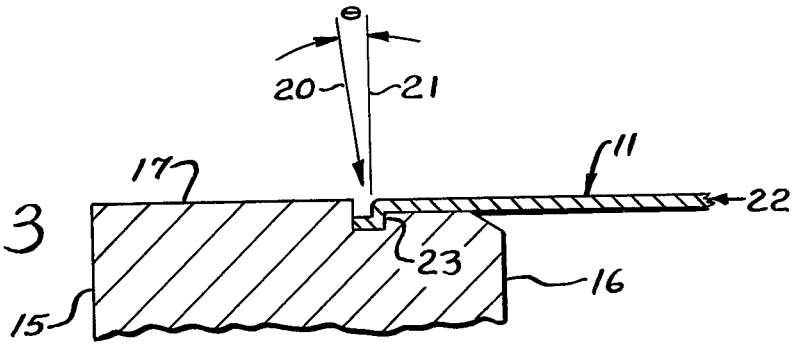
FIG. 3 is a view similar to FIG. 2 but illustrating a second and intermediate stage of joint fabrication.

After this step of installation has been performed, the portion of the tubing 11 overlying the channel 19 is subjected to a deforming force 20 — see FIG. 3. This is advantageously performed by suitable rolling apparatus of conventional design but I have found it further advantageous to arrange the apparatus so as to apply the force 20 at a minor acute angle relative to a radial line 21. Preferably, the angle is of the order of about 1°.

Inasmuch as the recess 19 is channel-shaped, i.e., characterized by substantially right angles, the deformation of the tubing 11 develops a similar configuration or right-angle step. This development, according to the invention, is accompanied by an axial force 22 simultaneously applied to the tubing 11 (again see FIG. 3).

The simultaneous forcing of the tubing 11 against the shoulder 18 while inwardly deforming the tubing 11 into the recess 19 not only causes cold working of the metal of the tubing 11 but metal flow as well so that there is a substantial amount of metal in the right angled step 23.

Figure 4:
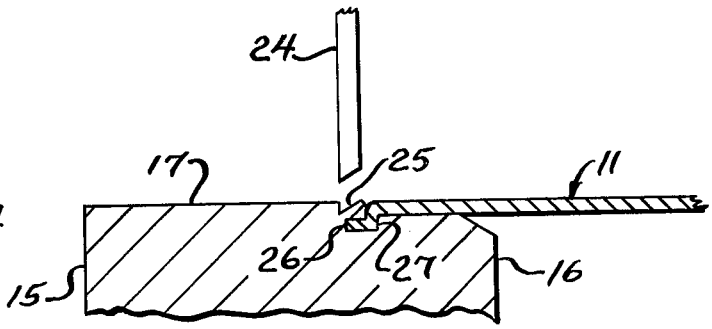
FIG. 4 is yet another view similar to FIGS. 2 and 3 but showing the third and final step in joint fabrication.

The final step in the formation of the joint or connection between the end cap 15 and the tubing 11 is illustrated in FIG. 4. There the numeral 24 designates a rolling-type tool which develps a cut in the portion 17 of the end cap 15 — and relatively close to the shoulder 18. This results in a tongue or lip-like integral projection 25 which overlies the right- angle step portion 23 and clamps the same to the shank 16. More particularly, the tongue 25 overlies the horizontal leg 26 of the right angle step 23 and firmly abuts the vertical portion 27 of the step 23.

In the practice of the invention, the end caps 14 and 15 are advantageously provided of a suitable metal such as brass or anodized aluminum. The diameter of the end caps varies according to the size of the cylindrical tubing 11 and normally this will be available in a variety of sizes ranging from ¼inches to 2-½inches in diameter of bore. The end caps 14 and 15 are suitably machined to provide the reduced diameter shank 16 and the recess 19.

The tubing 11 is advantageously constructed of suitable tubing materials, for example, type 304 stainless steel, and best results are obtained when this is in the ¼ to ⅜ hard condition. Utilizing a harder stainless steel, as is achieved through a greater number of passes of the tubing through the drawing dies, can result in embrittlement and possible cracking in the area of the right-angle step 23. It has been found advantageous to preserve a degree of ductility in the stainless steel tubing 11 by limiting the hardness within the range of about ¼ to about ⅜ hard condition.

Although the mechanism by which the invention works is imperfectly understood, it is believed that the simultaneous application of radial and axial forces to the end portion of the somewhat ductile tubing 11 results in an advantageous cold working and metal flow to develop a conforming step in the tubing end portion which has substantial strength in resisting the destructive shocks encountered in the use of the cylinder 10. Further, the pronounced step provides a dual anchor for the tongue 25 in both overlying and clamping the horizontal leg 26 and by abuting and clamping the vertical leg 27.

I claim:

1. A method of making an end connection to a fluid power cylinder comprising the steps of:

providing a cylindrical end cap having a reduced diameter, integral shank at one end thereof and defining with the remainder of said cap a radially extending shoulder, said shank being equipped with a channel-shaped annular inwardly extending recess adjacent said shoulder, inserting said shank into a hollow metallic cylindrical tubing to cause said tubing to abut said shoulder, simultaneously forcing said tubing against said shoulder while inwardly deforming said tubing into said recess to cause cold working and metal flow in said tubing and to form an integral, generally right-angle step portion therein, and deforming said end cap to cause an integral portion thereof to overlie and clamp said right-angle step portion to said shank.

2. The method of claim 1 in which said tubing deformation step includes the application of a rolling force to said tubing rolling force extending in a direction forming a minor acute angle with a radial line extending from the axis of said cylinder.

3. The method of claim 2 in which said angle is approximately 1°.

4. The method of claim 1 in which said tubing is constructed of stainless steel in the range of about ¼ to ⅜ hard condition.

* * * * *